US010501289B2

(12) United States Patent
Rasanen et al.

(10) Patent No.: US 10,501,289 B2
(45) Date of Patent: Dec. 10, 2019

(54) METHOD AND ARRANGEMENT FOR INSTALLING AN ELEVATOR

(71) Applicants: Matti Rasanen, Hyvinkaa (FI); Markku Haivala, Hyvinkaa (FI); Markku Haapaniemi, Helsinki (FI); Jouni Ratia, Hyvinkaa (FI); Janne Mikkonen, Jarvenpaa (FI); Esko Aulanko, Kerava (FI)

(72) Inventors: Matti Rasanen, Hyvinkaa (FI); Markku Haivala, Hyvinkaa (FI); Markku Haapaniemi, Helsinki (FI); Jouni Ratia, Hyvinkaa (FI); Janne Mikkonen, Jarvenpaa (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 253 days.

(21) Appl. No.: 15/433,062

(22) Filed: Feb. 15, 2017

(65) Prior Publication Data

US 2017/0166419 A1 Jun. 15, 2017

Related U.S. Application Data

(63) Continuation of application No. PCT/FI2014/050666, filed on Sep. 1, 2014.

(51) Int. Cl.
*B66B 19/02* (2006.01)
*B66B 19/00* (2006.01)

(52) U.S. Cl.
CPC ..... *B66B 19/02* (2013.01); *B66B 19/00* (2013.01); *B66B 19/005* (2013.01)

(58) Field of Classification Search
CPC ..... B66B 19/005; B66B 19/02; B66B 19/04
See application file for complete search history.

(56) References Cited

U.S. PATENT DOCUMENTS 5,033,586 A 7/1991 Richards et al.
10,227,212 B2 * 3/2019 Alasentie ..... B66B 11/0045
(Continued)

FOREIGN PATENT DOCUMENTS

CN 103303771 A 9/2013
WO WO-2013/079790 A1 6/2013

OTHER PUBLICATIONS

European Search Report for corresponding European Application No. 14901081.1 dated Mar. 8, 2018.
(Continued)

*Primary Examiner* — Diem M Tran
(74) *Attorney, Agent, or Firm* — Harness, Dickey & Pierce, P.L.C.

(57) ABSTRACT

The invention relates to a method and arrangement for installing an elevator, which comprises an elevator car arranged to run in an elevator shaft along the guide rails, a balancing weight connected to the elevator car with suspension ropes and with a traction member, the elevator comprising further a hoisting machinery with a driving wheel in the lower part of the elevator shaft below the elevator car, the installing comprising one or more jumps to make the elevator serve higher floors. During the jump phase extensions needed for the suspension ropes are taken from first supply reels and extensions needed for the traction member are taken from second supply reels.

12 Claims, 5 Drawing Sheets

(56) References Cited

U.S. PATENT DOCUMENTS

Figure 1:
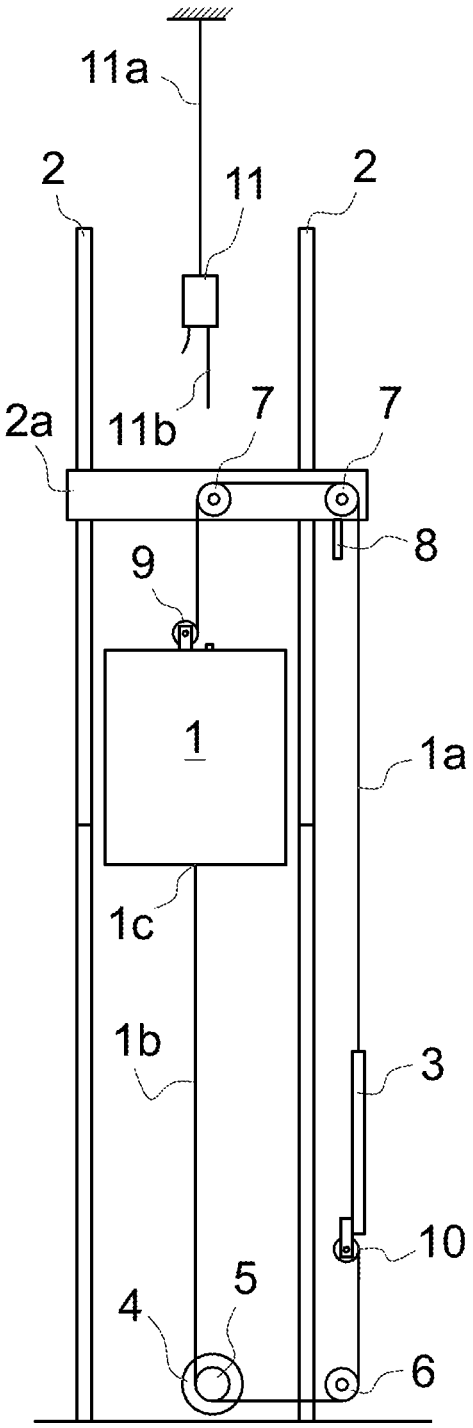

| | | | | |
|---|---|---|---|---|
| 2012/0291395 | A1* | 11/2012 | Plathin | B66B 19/00 52/741.1 |
| 2014/0000987 | A1 | 1/2014 | Peacock et al. | |
| 2014/0231179 | A1 | 8/2014 | Alasentie | |
| 2015/0034425 | A1* | 2/2015 | Ratia | B66B 7/06 187/249 |

OTHER PUBLICATIONS

International Search Report PCT/ISA/210 for International Application No. PCT/FI2014/050666 dated May 19, 2015.
Written Opinion of the International Searching Authority PCT/ISA/237 for International Application No. PCT/FI2014/050666 dated May 19, 2015.
Chinese Office Action dated Jun. 28, 2018 issued in corresponding Chinese Application No. 201480081669.6 (with translation).

* cited by examiner

METHOD AND ARRANGEMENT FOR INSTALLING AN ELEVATOR

This application is a continuation of PCT International Application No. PCT/FI2014/050666 which has an International filing date of Sep. 1, 2014, the entire contents of which are incorporated herein by reference.

The present invention relates to a method and to an arrangement for installing an elevator.

In prior art solutions where elevators are needed before the building has been completed so-called jump elevators are used during the construction time. Usually jump elevators are used only in high-rise buildings and all the work related to jump elevators is rather complicated because the whole temporary machine room with its machinery and electric connections is moved in a stepwise manner to a higher floor and the at the same time the length of the hoisting rope in use is increased accordingly. That means in general that all the components depending on the hoisting height, such as car cables, compensating ropes, overspeed governors and shaft electrification and shaft cables should be extended over the entire length of the finished elevator shaft. All this causes a lot of work, which also make the process slow.

U.S. Pat. No. 5,033,586 shows a prior art solution where a temporary elevator machine room module comprising two levels in a frame can be lifted to a desired height and secured at its new position. The elevator machinery with the ordinary machine room components and hoisting rope supplies with rope reels are placed on the upper space of the module. When the machine room module is to be moved, the elevator car is locked at its place, and the required additional rope length is supplied from the reels of the hoisting rope supply. A disadvantage with this solution is that the whole hoisting rope supply with the reels and all the components of the machine room have to be lifted together with the machine room, and in addition all the electrification has to be deactivated and then built again when the elevator machine room module is in its new location. Heavy hoists are needed and the installation work is difficult and also slow and dangerous. The dismantling of the temporary machine room module causes also a lot of waste material and takes time.

The object of the present invention is to eliminate drawbacks of prior art technology and to achieve an advantageous, fast and easy method and arrangement for installing an elevator in lower-rise buildings so that the elevator can be used during the construction time and the use can be extended to a higher operation level as the construction work is progressing, and which elevator is also applicable for use as a normal elevator in the finished building. The method according to the invention is characterized by, during a jump to make the elevator serve a higher floor, taking extensions needed for a suspension ropes from one or more first supply reels and taking extensions needed for a traction member from one or more second supply reels, and the arrangement according to the invention is characterized by the arrangement comprising one or more first supply reels for the extensions needed for the suspension ropes during the jump and one or more second supply reels for the extensions needed for the traction member during the jump. Other embodiments of the invention are characterized by what is presented in the other claims.

The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

The method and arrangement according to the invention have several useful advantages. Among other things it makes it possible to use the elevator during the construction time in an economical and fast way. The method and arrangement according to the invention makes it possible to use a jump-elevator installation technology economically also in lower-rise buildings. In that case elevators can be used in lower-rise buildings earlier which increases a total usage of the elevators. Because there is no need to lift the hoisting machinery and all the rope supplies in connection with the jump the jump is easier and faster to make and does not need as heavy hoisting devices as prior art systems. One big advantage is that there is no need to move the electricity supply because the hoisting machinery stays at its place all the time. Yet one advantage is that the own hoisting machinery can be used at least partially for the installation. Also one advantage is that the method and arrangement according to the invention cause only a minimal amount of waste material, because, for example the method and arrangement according to the invention does not need a temporary machine room that should be dismantled after the installation.

An advantageous way to carry out the invention is to install an elevator, comprising at least a car, a balancing weight, their guide rails, hoisting machinery, suspension ropes connecting the car and the balancing weight from up, a traction member connecting the car and the balancing weight from down and driving wheel driven by the hoisting machine and tractively connected to the traction member in such manner that the elevator is installed at least in two phases, using so called jump method. Between the jumps the elevator is serving number of the floors, usually the lowermost floors of the building or the lowermost floors of a particular elevator shaft. During a jump phase the working elevator is build taller and the extensions needed for each suspension rope is taken from a respective suspension supply reel and extension needed for each traction member is are taken from a respective traction member supply reel.

During the jumps, both suspension ropes and traction ropes can be released from their reels at the same time. Suspension rope release and traction member release from their reels can be done in a sequence or by alternating them.

Preferably the hoisting machine is installed to its final place in early phase of the installation and its place is not changed during or between the jumps. In the an auxiliary hoist is preferably used, when the pulley(s) which suspend(s) the suspension ropes above the elevator car are moved to an upper position.

Figure 2:
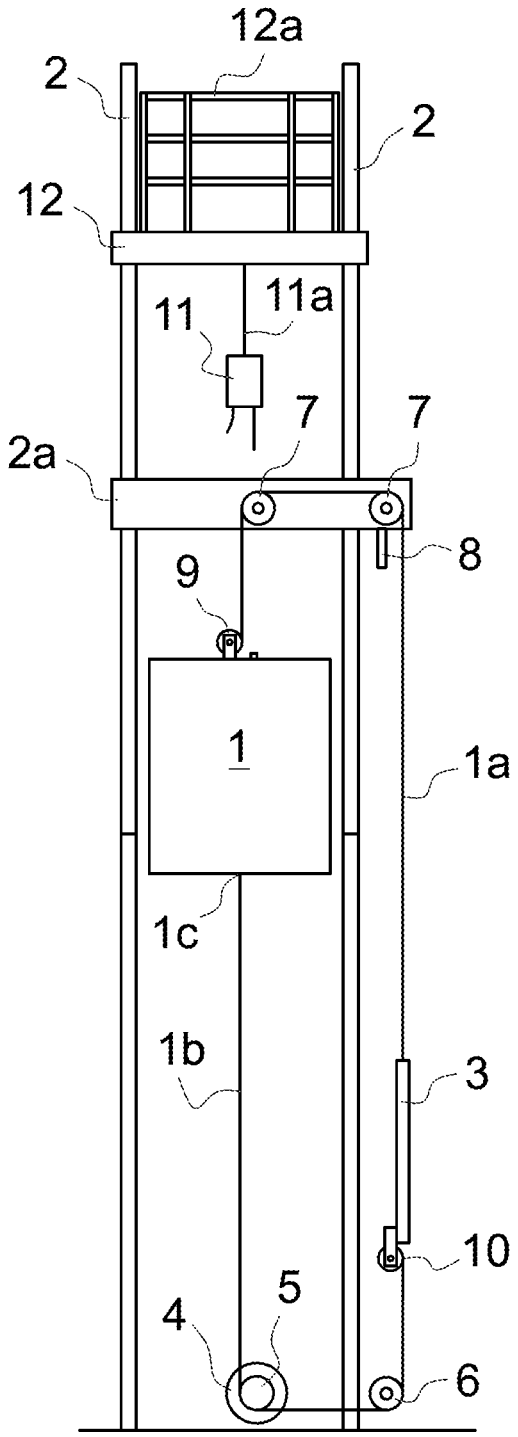
Figure 3:
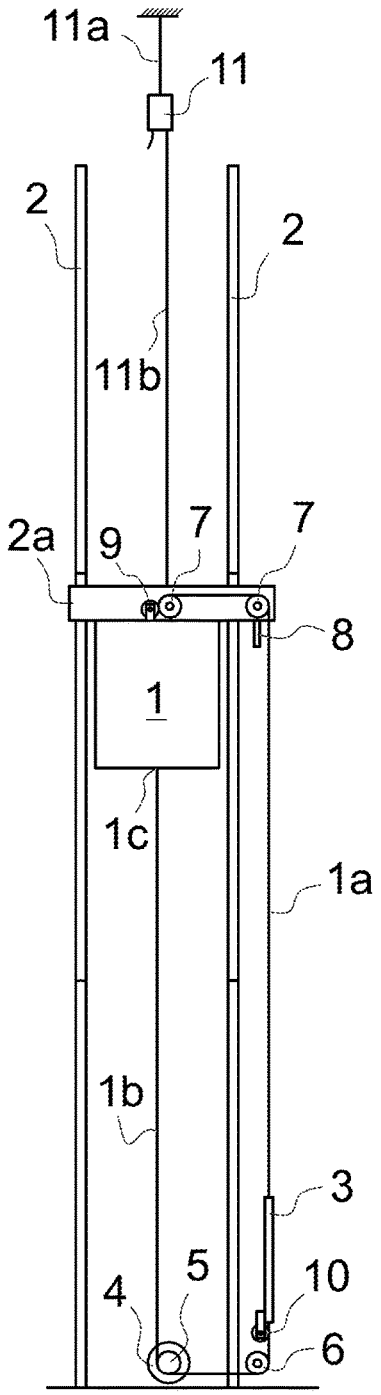
Figure 4:
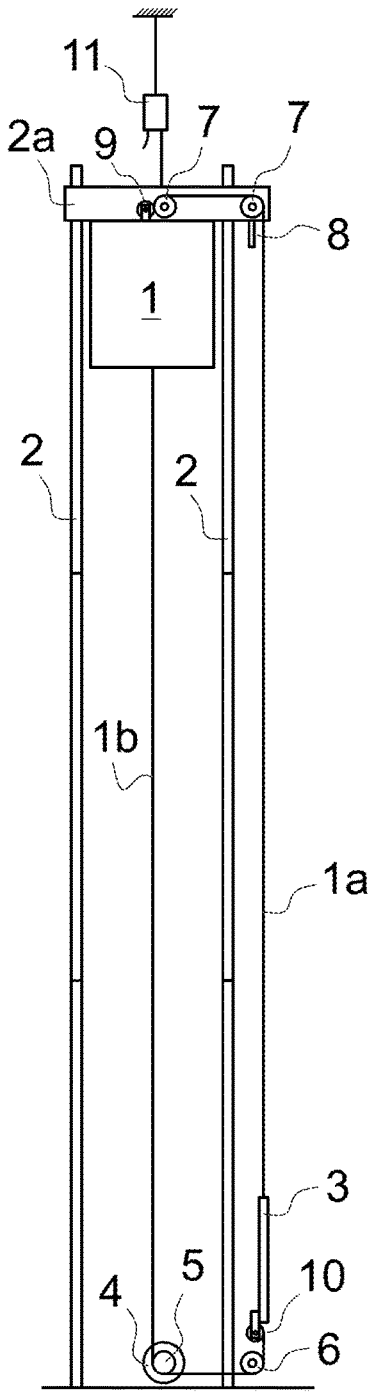
Figure 5:
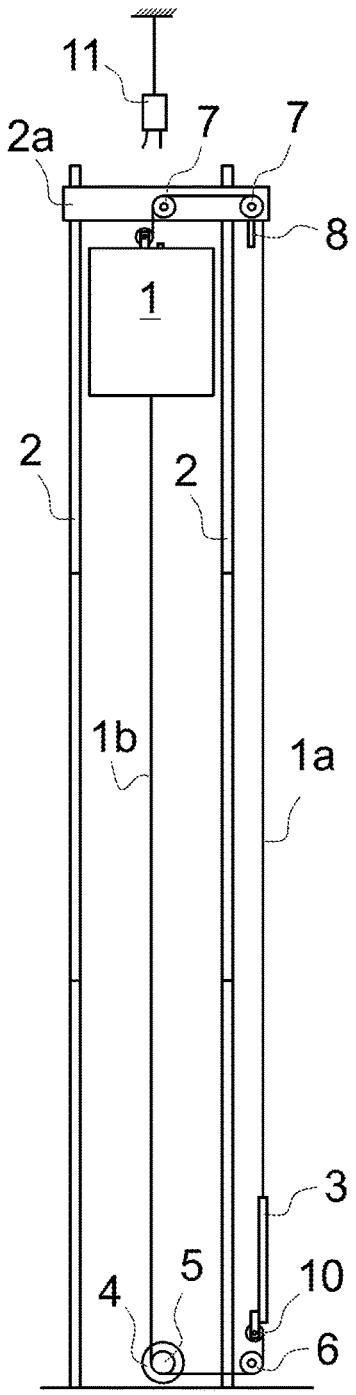
Figure 6:
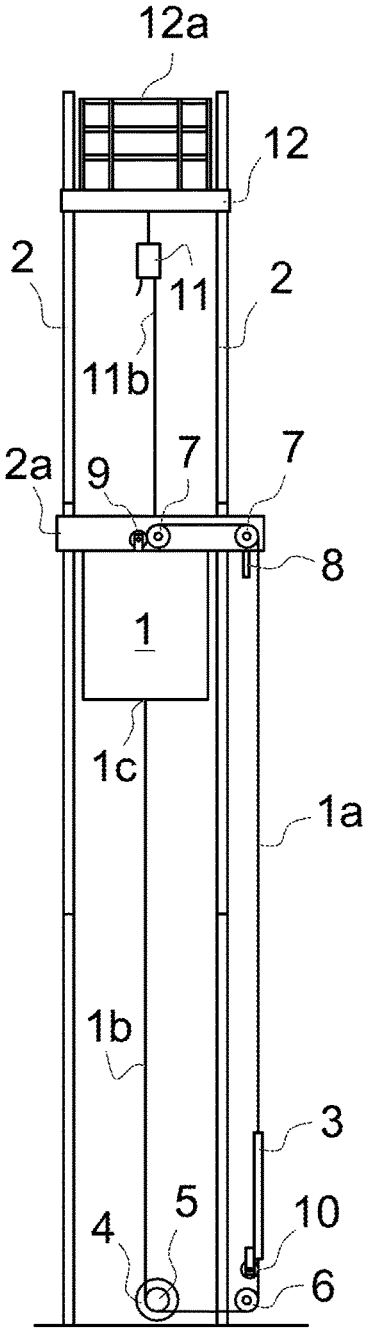
Figure 7:
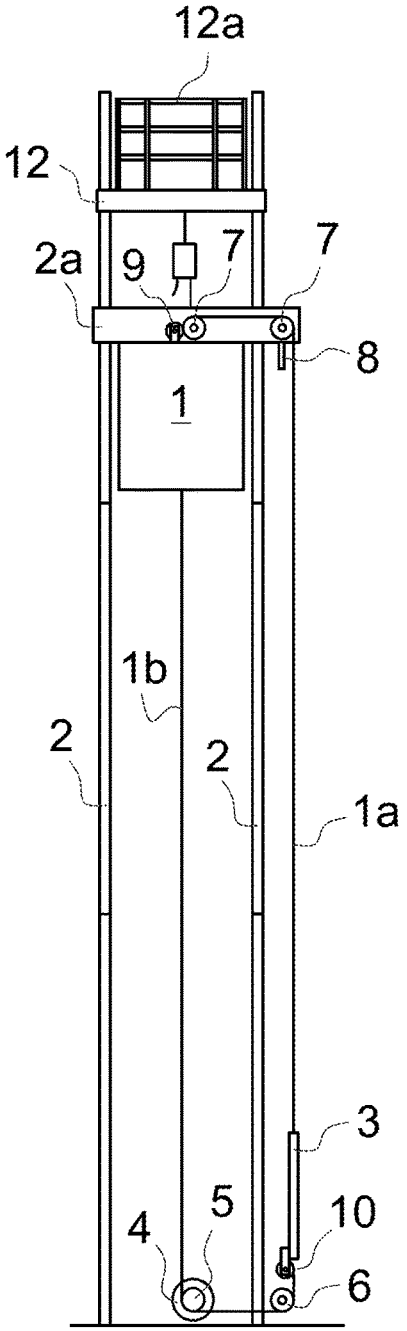
Figure 8:
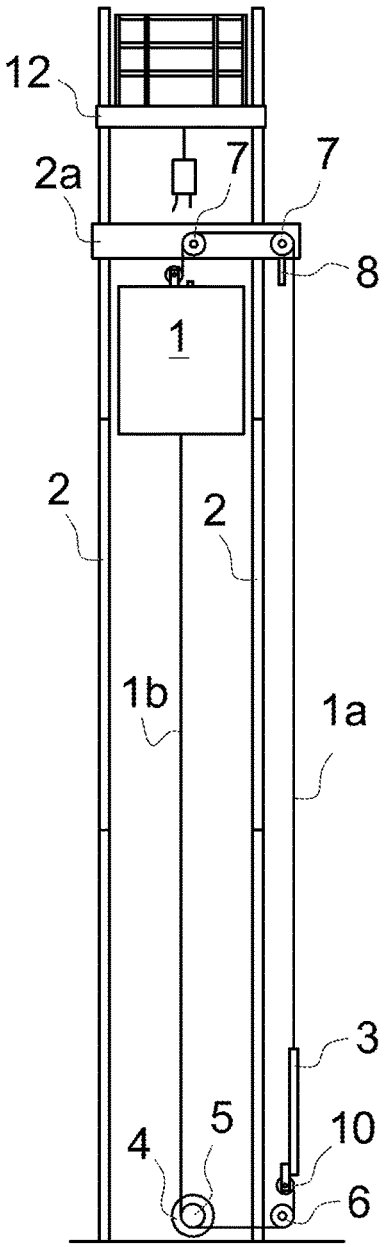
Figure 9:
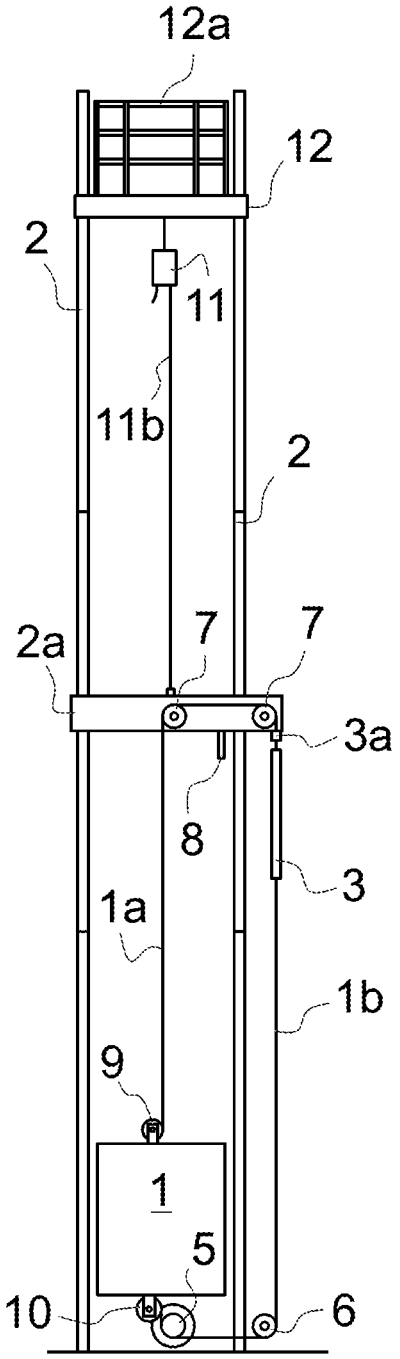
Figure 10:
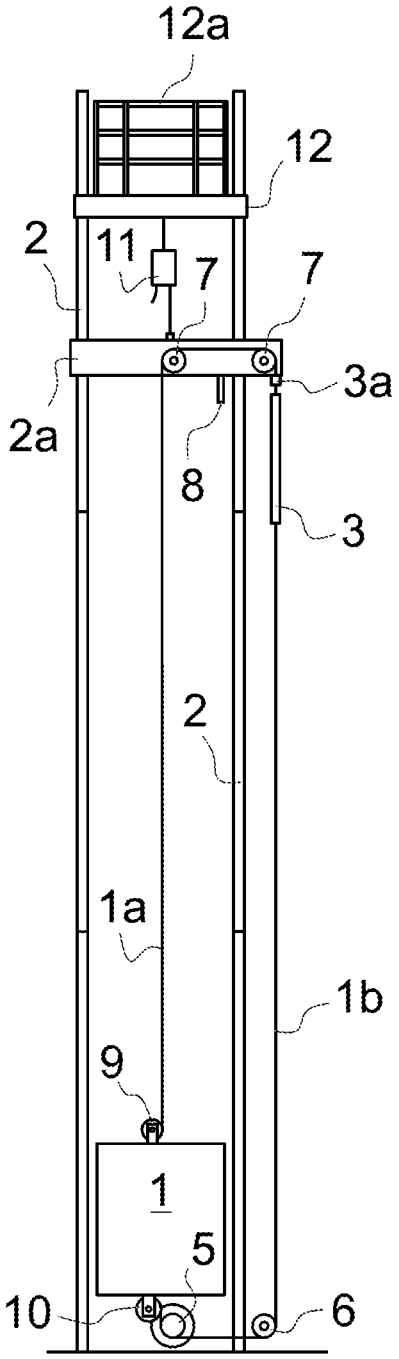
Figure 11:
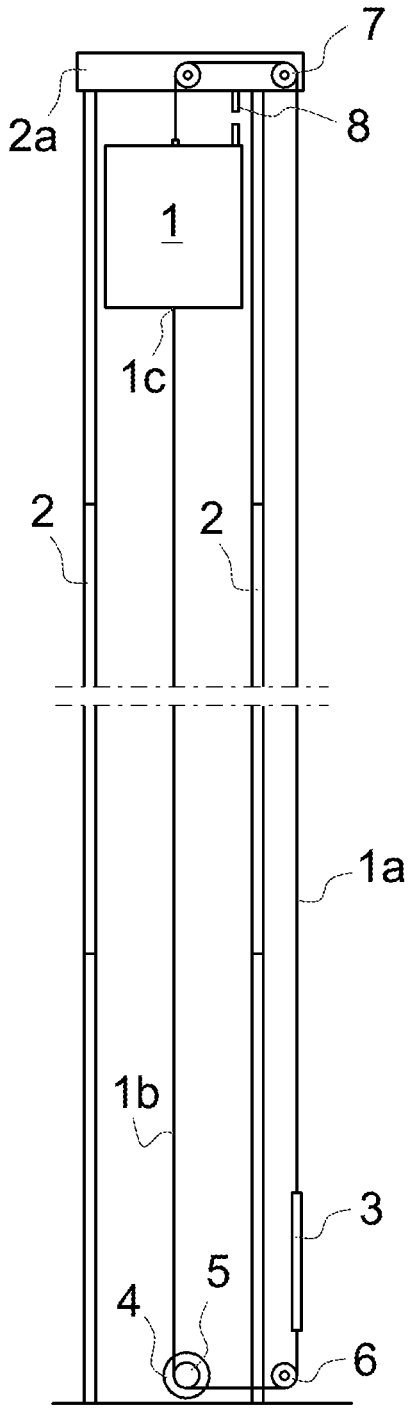

In the following, the invention will be described in detail by the aid of example embodiments by referring to the attached simplified and diagrammatic drawings, wherein FIG. 1 presents in a simplified and diagrammatic front view an elevator arrangement according to the invention with an elevator car capable for a normal service in the elevator shaft when the building is in the construction phase, FIG. 2 presents in a simplified and diagrammatic front view another elevator arrangement according to the invention with an elevator car capable for a normal service in the elevator shaft when the building is in the construction phase, FIG. 3 presents in a simplified and diagrammatic front view an elevator arrangement according to FIG. 1 in the situation where a jump to a higher level is in its initial phase, FIG. 4 presents in a simplified and diagrammatic front view an elevator arrangement according to FIG. 1 in the situation where a jump to a higher level is in its final phase, FIG. 5 presents in a simplified and diagrammatic front view an elevator arrangement according to FIG. 1 in the situation where a jump to a higher level has been just completed, FIG. 6 presents in a simplified and diagrammatic front view an elevator arrangement according to FIG. 2 in the situation where a jump to a higher level is in its initial phase, FIG. 7 presents in a simplified and diagrammatic front view an elevator arrangement according to FIG. 2 in the situation where a jump to a higher level is in its final phase, FIG. 8 presents in a simplified and diagrammatic front view an elevator arrangement according to FIG. 2 in the situation where a jump to a higher level has been just completed, FIG. 9 presents in a simplified and diagrammatic front view yet another elevator arrangement according to the invention in the situation where a jump to a higher level is in its initial phase, FIG. 10 presents in a simplified and diagrammatic front view an elevator arrangement according to FIG. 9 in the situation where a jump to a higher level is in its final phase, and FIG. 11 presents in a simplified and diagrammatic front view an elevator arrangement according to the invention in the situation where the building is in its final height and the elevator is in its normal service.

It is essential to the solution according to the invention that any temporary machine room is not needed and that the hoisting machinery is not lifted during jumps to a higher level.

FIGS. 1 and 2 present two basic embodiments of a method and an arrangement according to the invention for installing an elevator that is capable for a normal service in the lowermost parts of the elevator shaft when the building is in the construction phase. In the embodiment of FIG. 1 the installation is done without a special installation stage 12 and in the embodiment of FIG. 2 the installation is done with such kind of a special installation stage 12 with safety railings 12*a*. Otherwise the installation methods can be basically similar but some installation phases can be performed better on the installation stage 12 than on the roof of the elevator car.

The basic embodiments of FIGS. 1 and 2 comprise an elevator car 1 that is arranged to move up and down in an elevator shaft along the guide rails 2. The elevator car 1 is suspended by suspension ropes 1*a* that are connected between a balancing weight 3 and the elevator car 1 so that the first ends of the suspension ropes 1*a* are secured to the upper part of the balancing weight 3 and from the balancing weight 3 the suspension ropes 1*a* are fed upwards to go over and around a first and second diverting pulley 7 that are journaled on their shafts at a support beam 2*a* which is fastened to the guide rails 2 above the elevator car 1. The balancing weight 3 is arranged to run along its own guide rails that are not shown in the figures for the sake of clarity. Instead of the balancing weight 3 also a counterweight can be used, but later only the term balancing weight is mentioned. From the second diverting pulley 7 the suspension ropes 1*a* descend to a rope supply reel 9 that is secured on the roof of the elevator car 1. The rope supply reel 9 acts as the first supply reel. Depending on need the rope supply reels 9 can also be more than one. The rope supply reel 9 acts as a rope supply for the jumps to higher levels. During the normal service of the elevator in the construction phase the rope supply reel 9 is locked from rotating and the suspension ropes 1*a* are secured by clamps or other suitable way so that the length of the suspension ropes 1*a* between the car 1 and the balancing weight 3 does not change unintentionally. An over speed governor 8 is assembled in the support beam 2*a* to control possible over speed cases.

The supporting and moving of the elevator car 1 are separated from each other. The elevator car 1 is driven by a hoisting machinery 4 equipped with a drive wheel 5. The hoisting machinery 4 is placed in the lower part of the elevator shaft below the elevator car 1 into its final location in the initial installation phase before the later jumps to be done. A traction member 1*b* is connected between the balancing weight 3 and the elevator car 1. The traction member 1*b* can be a single member or a bunch of similar parallel members, for instance the traction member 1*b* can be a toothed belt, chain or other type of member that does not slip on the drive wheel 5.

A first end of the traction member 1*b* is secured in its fastening point 1*c* at the bottom of the elevator car 1 and from the fastening point 1*c* the traction member 1*b* is passed around and under the drive sheave 5 of the hoisting machinery 4, and from the drive sheave 5 the traction member 1*b* is further passed under and around a diverting pulley 6 to a supply reel 10 that is secured on the lower part of the balancing weight 3. The supply reel 10 acts as the second supply reel. Depending on need the supply reels 10 can also be more than one. The supply reel 10 acts as a traction member supply for the jumps to higher levels. During the normal service of the elevator in the construction phase the supply reel 10 is locked from rotating and the traction member 1*b* is secured by clamps or other suitable way so that the length of the traction member 1*b* between the car 1 and the balancing weight 3 does not change unintentionally.

In the embodiment of FIG. 1 an auxiliary hoist 11 used during the installation of the elevator is suspended from a fixed point of the building by a suspension rope or chain 11*a*. The auxiliary hoist 11 has a hoisting rope or chain 11*b* that is secured to the support beam 2*a* and to the elevator car 1 in turns when making a jump. In the embodiment of FIG. 2 the auxiliary hoist 11 used during the installation of the elevator is suspended from the installation stage 12 that has been secured in the upper part of the guide rails 2. The auxiliary hoist 11 with its ropes is basically similar to the hoist 11 shown in FIG. 1.

The first method according to the invention comprises among other things for instance the following steps in the initial phase:

1) Initial rise installation
2) Installation of the final hoisting machinery 4 with the final drive wheel 5 into their final location in the lower part of the elevator shaft, and installation of the first guide rails 2
3) Installation of the over speed governor 8 and a tension weight
4) Installation of the balancing weight 3 to its own guide rails
5) Assembling the support beam 2*a* with its diverting pulleys 7 and supporting the support beam 2*a* on the roof of the elevator car 1
6) Suspending the elevator car 1 from the auxiliary hoist 11, and lifting the elevator car 1 with the support beam 2*a* upwards in the elevator shaft by the help of the auxiliary hoist 11

7) Installation of the next upper guide rails 2 and, for instance, landing doors when working on the roof of the elevator car 1
8) Securing the support beam 2*a* to the guide rails 2 at an appropriate height
9) Installation of other components, such as electrification, the suspension ropes 1*a* and the traction member 1*b*
10) Disengaging the auxiliary hoist 11 from the elevator car 1
11) Tensioning of the traction member 1*b*
12) Commissioning of the elevator.

After the last step 12) the elevator car 1 can run in the elevator shaft and the elevator is able to serve the lowermost floors of the building though the building is still under construction.

FIGS. 3-5 show different situations during the installation phase according to the invention when the separate installation stage 12 is not used and certain installation phases are made on the roof of the elevator car 1. In FIG. 3 the initial installation has been done and a jump to a higher level is in its initial phase, and in FIG. 4 the jump is in its final phase. Whereas in the situation of FIG. 5 the jump has just been completed.

The first method according to the invention comprises among other things for instance the following steps in the jump situation:

13) Running the elevator car 1 with its own hoisting machinery 4 to its uppermost position
14) Suspending the elevator car 1 from the auxiliary hoist 11
15) Unlocking of the suspension rope reel 9 and the traction member 1*b* reel 10
16) Detaching the support beam 2*a* from the guide rails 2 and supporting it on the roof of the car 1
17) Installation of the next upper guide rails 2 and, for instance, landing doors when working on the roof of the elevator car 1; during this phase the elevator car 1 is lifted gradually upwards with the auxiliary hoist 11 and at the same time the needed extension of the suspension rope 1*a* is drawn from the suspension rope supply reel 9 and also the needed extension of the traction member 1*b* is drawn from the traction member supply reel 10 either non-simultaneously or preferably simultaneously with suspension rope, and so that the lengths of the extensions of the traction member 1*b* and suspension rope are for a car run of an equal length
18) Securing the support beam 2*a* to the guide rails 2 at an appropriate new height
19) Installation of other components, such as electrification, etc.
20) Descending the elevator car 1 into an appropriate floor level
21) Locking of the suspension rope reel 9 and the traction member 1*b* reel 10
22) Disengaging the auxiliary hoist 11 from the elevator car 1
23) Tensioning of the traction member 1*b*
24) Commissioning of the elevator The order of some steps may occasionally change. After the step 24) above the elevator is ready for service according to FIG. 5, still having supply reels 9 and 10 until the whole elevator shaft is at its maximum height. Then the final conversion is done and after that the elevator is ready for normal service.

The first method according to the invention comprises among other things for instance the following steps in the situation of the final conversion:

25) Making the last jump as a normal jump according to the phases mentioned above
26) Replacing the temporary lock or clamps used for locking the suspension ropes 1*a* and traction member 1*b* with permanent clamps, for instance to rope bottles
27) Repositioning the over speed governor 8 to the support beam 2*a* or to the guide rail 2
28) Removing the supply reels 9 and 10 and adjusting the balancing weight 3 for final use
29) Securing and tensioning of the traction member 1*b*
30) Commissioning the elevator.

In this embodiment the steps as follows are made and/or can be made on the roof of the elevator car 1: 5)-10), 14)-22) and 26)-28).

FIG. 2 and FIGS. 6-8 show an embodiment according to the invention where the separate installation stage 12 is used to make the installation safer and easier. Basically most of the steps in this method can be the same or almost the same as the steps mentioned above. The biggest difference is the assembling of the installation stage 12, its use during the installation and its dismantling after the installation of the elevator.

The second method according to the invention comprises among other things for instance the following steps in the initial phase:

101) Initial rise installation
102) Installation of the final hoisting machinery 4 with the final drive wheel 5 into their final location in the lower part of the elevator shaft, and installation of the first guide rails 2
103) Installation of the balancing weight 3 to its own guide rails
104) Installation of the installation stage 12
105) Installation of the next upper guide rails 2 and, for instance, landing doors when working on the installation stage 12
106) Installation of the elevator car 1
107) Assembling the support beam 2*a* with its diverting pulleys 7 and over speed governor 8, and placing the support beam 2*a* on the roof of the elevator car 1
108) Suspending the elevator car 1 from the installation stage 12 by the auxiliary hoist 11, and lifting the elevator car 1 with the support beam 2*a* upwards in the elevator shaft by the help of the auxiliary hoist 11; at the same time also the traction member 1*b* is drawn with the elevator car 1 through the hoisting machinery 4
109) Securing the support beam 2*a* to the guide rails 2 at an appropriate height
110) Roping the over speed governor 8 and adjusting it to work properly
111) Installation of the suspension ropes 1*a* and the traction member 1*b*
112) Disengaging the auxiliary hoist 11 from the elevator car 1
113) Tensioning of the traction member 1*b*
114) Making the electrification
115) Commissioning of the elevator.

After that the elevator car 1 can run in the shaft and the elevator is able to serve the lowermost floors of the building though the building is still under construction. At the same time when the elevator is in a normal service next upper guide rails 2 and landing doors can be installed working on the installation stage 12.

FIGS. 6-8 show different situations during the installation phase according to the invention when the separate installation stage 12 is used and certain installation phases are made on the roof of the elevator car 1 and certain installation phases are made on the installation stage 12. In FIG. 6 the initial installation has been done and a jump to a higher level is in its initial phase, and in FIG. 7 the jump is in its final phase. Whereas in FIG. 8 the jump has been completed and the elevator is ready for service, still having supply reels 9 and 10 until the whole elevator shaft is at its maximum height.

The second method according to the invention comprises among other things for instance the following steps in the jump situation:

116) Running the elevator car 1 with its own hoisting machinery 4 to its uppermost position 117) Locking the balancing weight 3 to the support beam 2*a*, for instance in a rope clamp 3*a*

118) Unlocking of the suspension rope reel 9 and the traction member reel 10 that both are now in the elevator car 1, the suspension rope reel 9 on top of the car 1 and the traction member reel 10 below the bottom of the car 1

119) Detaching the support beam 2*a* from the guide rails 2 and lifting the support beam 2*a* with the balancing weight 3 the upwards with the auxiliary hoist 11, and at the same time the needed extension of the suspension rope 1*a* is drawn from the suspension rope supply reel 9 and also non-simultaneously or preferably simultaneously the needed extension of the traction member 1*b* is drawn from the traction member supply reel 10

120) Locking of the suspension rope reel 9 and the traction member 1*b* reel 10

121) Securing the support beam 2*a* to the guide rails 2 at an appropriate new height 122) Disengaging the balancing weight 3 from the support beam 2*a*

123) Disengaging the auxiliary hoist 11 from the support beam 2*a*

124) Making the necessary electrification, etc.

125) Tensioning of the traction member 1*b*

126) Commissioning of the elevator

The order of some steps may occasionally change. After the step 126) above the elevator is ready for service. During the normal service next upper guide rails and landing doors, etc. can be installed using the installation stage 12 until the final height is reached.

The second method according to the invention comprises among other things for instance the following steps in the situation of the final conversion:

127) Repositioning the over speed governor 8 to the ceiling of the elevator shaft or to another suitable place 128) Suspending the elevator car 1 from the ceiling of the elevator shaft by the auxiliary hoist 11

129) Dismantling the installation stage 12

130) Running the elevator car 1 to its uppermost position

131) Unlocking of the suspension rope reel 9 and the traction member reel 10

132) Detaching the support beam 2*a* from the guide rails 2 and supporting it on the roof of the car 1

133) Lifting the elevator car 1 and the support beam 2*a* upwards with the auxiliary hoist 11 from the ceiling of the elevator shaft, and at the same time the needed extension of the suspension rope 1*a* is drawn from the suspension rope supply reel 9 and also non-simultaneously or preferably simultaneously the needed extension of the traction member 1*b* is drawn from the traction member supply reel 10

134) Securing the support beam 2*a* to the guide rails 2 at its final height 135) Making the necessary electrification, etc.

136) Replacing the temporary lock or clamps used for locking the suspension ropes 1*a* and traction member 1*b* with permanent clamps, for instance to rope bottles 137) Removing the supply reels 9 and 10 and adjusting the balancing weight 3 for final use 138) Securing and tensioning of the traction member 1*b*

139) Commissioning the elevator.

In this embodiment the steps as follows are made and/or can be made on the installation stage 12: 105), 108), 109), 114), 117), 119), 123), 124) and 127). Whereas the steps as follows are made and/or can be made on the roof of the elevator car 1: 105), 107), 109)-111), 114), 117)-124) and 128)-136).

FIGS. 9 and 10 show different situations during the installation phase according to another installation method of the invention when the separate installation stage 12 is used and certain installation phases are made on the roof of the elevator car 1 and certain installation phases are made on the installation stage 12. In FIG. 9 the initial installation and further installation have been done and a jump to a higher level is in its initial phase, and in FIG. 10 the jump is in its final phase. This method differs from the methods described earlier in that now both the supply reels 9 and 10 are in the elevator car 1, and the elevator car 1 is kept at the lower part of the elevator shaft during the jump. When the jump has been completed the elevator is ready for service, still having supply reels 9 and 10 until the whole elevator shaft is at its maximum height.

The fourth method according to the invention comprises among other things for instance the following steps in the jump situation:

240) Running the elevator car 1 with its own hoisting machinery 4 to its lowermost position 241) Suspending the elevator car 1 from installation stage 12 by the auxiliary hoist 11

242) Unlocking of the suspension rope reel 9 and the traction member reel 10

243) Detaching the support beam 2*a* from the guide rails 2 and supporting it on the roof of the car 1

244) Lifting the elevator car 1 and the support beam 2*a* upwards with the auxiliary hoist 11 from the installation stage 12, and at the same time the needed extension of the suspension rope 1*a* is drawn from the suspension rope supply reel 9 and also non-simultaneously or preferably simultaneously the needed extension of the traction member 1*b* is drawn from the traction member supply reel 10

245) Locking of the suspension rope reel 9 and the traction member 1*b* reel 10

246) Securing the support beam 2*a* to the guide rails 2 at an appropriate new height 247) Disengaging the auxiliary hoist 11 from the elevator car 1

248) Making the necessary electrification, etc.

249) Tensioning of the traction member 1*b*

250) Commissioning of the elevator

The order of some steps may occasionally change. After the step 250) above the elevator is ready for service, still having supply reels 9 and 10 until the whole elevator shaft is at its maximum height. During the normal service next upper guide rails and landing doors, etc. can be installed using the installation stage 12 until the final height is reached. The jump can be done in the same way also in the elevator arrangement where the installation stage 12 is not used. In that case the auxiliary hoist 11 suspending the support beam 2*a* is suspended from the fixed point in the building.

The steps of all the methods described here are very much the same in all installation phases. Only minor differences occur where some steps can vary, some step can be missing and some steps can be done in a different order. It is, however common to all the methods and the arrangements according to the invention that in the elevator installed the suspension and moving have been separated from each other and the only and final hoisting machinery 4 is in the lower part of the elevator shaft below the elevator car 1, for instance at the bottom of the elevator shaft. Then the hoisting machinery 4 is not lifted upwards in the jump phase, only the support beam 2*a* with the diverting pulleys 7 is lifted upwards during the jump with either the elevator car 1 or the balancing weight 3. And at the same time either the elevator car 1 or the balancing weight 3 is arranged to draw the extensions for the suspension ropes 1*a* and for the traction member 1*b* either non-simultaneously or preferably simultaneously from their own supply reels 9 and 10, and so that the lengths of the extensions of the traction member 1*b* and suspension ropes 1*a* are for a car run of an equal length.

The supply reels 9 and 10 can be placed mutually in a different moving object, for instance so that the reel or reels 9 for suspension ropes 1*a* are placed in the elevator car 1 and the reel or reels 10 for the traction member 1*b* are placed in the balancing weight 3, or vice versa. In that case the balancing during the jump may not change or the change is small and easy to compensate.

The supply reels 9 and 10 can also be placed mutually in the same moving object, for instance so that the reel or reels 9 for suspension ropes 1*a* are placed in the top part of the elevator car 1 and the reel or reels 10 for the traction member 1*b* are placed in lower part of the elevator car 1, or the reel or reels 9 for suspension ropes 1*a* are placed in the top part of the balancing weight 3 and the reel or reels 10 for the traction member 1*b* are placed in lower part of the balancing weight 3. In that case the balancing during the jump may change considerably and then the compensating of the change is important.

Thus, the jump phase in all the methods according to the invention may comprise a further step where the balancing is checked after the jump and, if needed, adjusted to be correct for instance by adding more weight either to the elevator car 1 or to the balancing weight 3.

After the whole elevator shaft is at its maximum height the final conversion is done according to one of the methods described above, and after the final conversion the elevator is ready for normal service according to the situation that is shown in FIG. 11.

Thanks to the inventive solution according to the invention the jump to the next higher level is easy and fast to make, and thus also shorter jumps can be economically done and consequently the elevator can serve the building also during the construction time more flexibly than in prior art solutions.

Instead of using the auxiliary hoist 11 mentioned above for suspending and lifting the elevator car 1, support beam 2*a* or balancing weight 3, or other components of the elevator the own hoisting machinery 4 of the elevator can be used mainly or at least partially for the installation described above.

It is obvious to the person skilled in the art that the invention is not restricted to the examples described above but that it may be varied within the scope of the claims presented below.

The invention claimed is:

1. An elevator, comprising:

an elevator car configured to run in an elevator shaft along a plurality of guide rails;

a balancing weight connected to the elevator car with a suspension rope extending through an upper part of the elevator shaft above the elevator car and further connected to the elevator car via a traction member extending through a lower part of the elevator shaft below the elevator car;

hoisting machinery including a driving wheel in the lower part of the elevator shaft below the elevator car;

a first supply reel configured to supply additional suspension rope to extend the suspension rope, the first supply reel secured on a roof of the elevator car; and a second supply reel configured to supply additional traction member to extend the traction member, the second supply reel secured on a lower part of one element of the balancing weight or the elevator car, such that the second supply reel is configured to have no relative motion in relation to the one element when the one element is in motion in relation to the elevator shaft, wherein the elevator is configured to be extended to enable the elevator car to run through a higher portion of the elevator shaft to serve one or more higher floors, based on the suspension rope and the traction member each being extended.

2. The elevator according to claim 1, wherein the hoisting machinery is configured to remain in a final location during extension of the elevator, and the hoisting machinery is configured to move the elevator car and the balancing weight during each extension of the elevator.

3. The elevator according to claim 1, further comprising:

a support beam including one or more diverting pulleys configured to carry the suspension rope, the support beam configured to be is secured detachably to the plurality of guide rails above the elevator car to suspend the elevator car and the balancing weight and to enable usage of the elevator possible between separate extensions of the elevator.

4. The elevator according to claim 3, further comprising:

a separate movable installation stage that is secured to an upper end of the plurality of guide rails to enable installation of an installation phase at upper floors of the elevator while the elevator is in a normal service for lowermost floors, the separate movable installation stage configured to act as a suspension support for an auxiliary hoist to enable lifting of the elevator car or the support beam during each extension of the elevator, wherein the second supply reel is secured on the lower part of the balancing weight.

5. The elevator according to claim 1, wherein the first supply reel and the second supply reel are configured to be selectively unlocked to rotate based on whether the elevator is being extended.

6. An elevator, comprising:

an elevator car configured to run in an elevator shaft along a plurality of guide rails;

a balancing weight connected to the elevator car with a suspension rope extending through an upper part of the elevator shaft above the elevator car and further connected to the elevator car via a traction member extending through a lower part of the elevator shaft below the elevator car;

hoisting machinery including a driving wheel in the lower part of the elevator shaft below the elevator car;

a first supply reel configured supply additional suspension rope to extend the suspension rope; and a second supply reel configured to supply additional traction member to extend the traction member, wherein the traction member is fixed at one end to the balancing weight and is fixed at an opposite end to a lower part of the elevator car, wherein the elevator is configured to be extended to enable the elevator car to run through a higher portion of the elevator shaft to serve one or more higher floors, based on the suspension rope and the traction member each being extended.

7. The elevator according to claim 6, wherein the hoisting machinery is configured to remain in a final location during extension of the elevator, and the hoisting machinery is configured to move the elevator car and the balancing weight during each extension of the elevator.

8. The elevator according to claim 6, further comprising:

a support beam including one or more diverting pulleys configured to carry the suspension rope, the support beam configured to be is secured detachably to the plurality of guide rails above the elevator car to suspend the elevator car and the balancing weight and to enable usage of the elevator possible between separate extensions of the elevator.

9. The elevator according to claim 8, further comprising:

a separate movable installation stage that is secured to an upper end of the plurality of guide rails to enable installation of an installation phase at upper floors of the elevator while the elevator is in a normal service for lowermost floors, the separate movable installation stage configured to act as a suspension support for an auxiliary hoist to enable lifting of the elevator car or the support beam during each extension of the elevator.

10. The elevator according to claim 9, wherein the balancing weight is configured to be driven to a location adjacent to and under the support beam and locked to the support beam that is suspended from an auxiliary hoist.

11. The elevator according to claim 6, wherein the first supply reel and the second supply reel are configured to be selectively unlocked to rotate based on whether the elevator is being extended.

12. The elevator according to claim 6, wherein the first supply reel is secured on a roof of the elevator car; and the second supply reel is secured on a lower part of the balancing weight or a lower part of the elevator car.

* * * * *